US006762150B2

(12) United States Patent
Sawano

(10) Patent No.: US 6,762,150 B2
(45) Date of Patent: Jul. 13, 2004

(54) IMAGE RECORDING APPARATUS AND METHOD AND RECORDING SHEET FOR USE THEREWITH

(75) Inventor: Mitsuru Sawano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 103 days.

(21) Appl. No.: 10/026,762

(22) Filed: Dec. 27, 2001

(65) Prior Publication Data

US 2002/0122107 A1 Sep. 5, 2002

(30) Foreign Application Priority Data

Dec. 27, 2000 (JP) ..... 2000-398268

(51) Int. Cl.[7] ..... B41M 5/30

(52) U.S. Cl. ..... 503/201; 347/163; 347/164; 347/165; 347/166; 503/200; 503/226

(58) Field of Search ..... 347/163, 164, 347/165, 166; 503/200, 201, 202, 226

(56) References Cited

U.S. PATENT DOCUMENTS 3,623,122 A * 11/1971 Fotland ..... 346/74 E 4,258,374 A * 3/1981 Pfeiffer ..... 346/163

* cited by examiner

*Primary Examiner*—B. Hamilton Hess
(74) *Attorney, Agent, or Firm*—Sughrue Mion, PLLC

(57) ABSTRACT

To provide an image recording method and apparatus that can record and display an image of free pattern without forming the complex wirings in an electrochromic material, and to reduce the manufacturing costs of the image recording apparatus employing the EC material.

A recording sheet 7 having a coloring layer made of an electrochromic material and an electrolytic layer with an increasing electrical conductivity in a specific temperature range is employed, and a recording head 13 with a plurality of heating elements arranged in a linear direction is moved relative to the surface of the recording sheet 7 in the direction orthogonal to the linear direction while at the same time a voltage is applied to the front and back faces of the recording sheet 7, thereby selectively heating the heating elements 11. Thereby, a coloring reaction is caused only in a part where heat is applied by the heating elements of the recording sheet 7 and voltage is applied to form an image on the recording sheet 7.

10 Claims, 6 Drawing Sheets

IMAGE RECORDING APPARATUS AND METHOD AND RECORDING SHEET FOR USE THEREWITH

BACKGROUND OF THE INVENTION

1. Field of the Invention

The present invention relates to an image recording method and apparatus and a recording sheet for use therewith, in which an image is recorded or displayed in colors, employing an electrochromic material that has light absorption reversibly changing in the electrochemical oxidation/reduction reaction.

2. Description of the Related Art

One of the display elements is an electrochromic (EC) element in which light absorption is reversibly changed through the electrochemical oxidation/reduction reaction. The EC element has a structure in which an EC material thin film and an electrolytic solution or solid electrolyte are laminated between the transparent electrodes, or a structure in which an EC material is dissolved in electrolytic solution.

In this EC element, by applying a voltage via a transparent electrode to the EC material thin film and the solid electrolyte laminated, electrochemical oxidation/reduction reaction is caused to bring about the coloring or decoloring reaction reversibly on the entire face of the EC material thin film. The EC element has a low driving voltage, and a memory property, and is the light absorption type to make a clear display without dependency on the angle of visibility under strong external lights.

Conventionally, the image recording apparatus using the EC element of this kind involved a driving method with a simple matrix in which a plurality of X electrodes with the EC material carried and a Y electrode are arranged in parallel at high definition, and the display pixels are made at their intersections.

However, the above image recording apparatus using the EC material was involved in bringing about the coloring or decoloring reaction at arbitrary part in such a way that a voltage is applied to the XY electrodes oppositely arranged in a matrix form, and the display pixels are made at their intersections, whereby a great number of wirings are required. Also, the composition of EC material became complex to increase the manufacturing costs.

SUMMARY OF THE INVENTION

The present invention has been achieved in the light of the above-mentioned situation, and it is an object of the invention to provide an image recording method and apparatus and a recording sheet for use therewith in which an image of free pattern can be recorded and displayed without forming the complex wirings in the EC material, and to reduce the manufacturing costs of the image recording apparatus using the EC material.

In order to accomplish the above object, according to a first aspect of the present invention, there is provided an image recording method employing a recording sheet having a coloring layer made of an electrochromic material and an electrolytic layer with an increasing electrical conductivity in a specific temperature range, characterized by including moving a recording head with a plurality of heating elements arranged in a linear direction relative to the surface of the recording sheet in the direction orthogonal to the linear direction while at the same time applying a voltage to the front and back faces of the recording sheet, and causing a coloring reaction only in a part where heat is applied by the heating elements to form an image on the recording sheet.

With this image recording method, the recording head is moved relative to the recording sheet, and a thermal stimulus is given from the heating elements to a desired display pixel, while at the same time a voltage is applied to the front and back faces of the recording sheet, whereby only a part where heat is applied by any heating elements is subjected to coloring reaction to form an image on the recording sheet. That is, a part where voltage and heat are applied becomes display pixels. Accordingly, an image of free pattern can be recorded and displayed without forming the complex wirings like a matrix in the EC material.

Also, according to a second aspect of the invention, there is provided an image recording method employing a recording sheet having a coloring layer made of an electrochromic material, characterized by including moving a recording head with a plurality of independent driving electrodes arranged in a linear direction relative to the surface of the recording sheet in the direction orthogonal to the linear direction, and causing a coloring reaction only in a part where voltage is applied by the independent driving electrodes to form an image on the recording sheet.

With this image recording method, the recording head having a plurality of independent driving electrodes arranged is moved relative to the surface of the recording sheet, and a part where voltage is applied by any independent driving electrodes is subjected to the coloring reaction to form an image on the recording sheet. That is, a part where voltage is applied becomes display pixels. Accordingly, an image of free pattern can be recorded and displayed without forming the complex wirings like a matrix in the EC material.

Further, according to a third aspect of the invention, there is provided the image recording method, characterized in that the recording sheet is a laminated recording sheet in which a plurality of recording sheets coloring in different colors are laminated in multiple stages, in which an image is formed by applying selectively a voltage to a recording sheet of each color.

With this image recording method, a multi-color image can be recorded and displayed by applying a voltage selectively to the recording sheet for each color of yellow (Y), magenta (M) and cyan (C), for example.

According to a fourth aspect of the invention, there is provided the image recording method, characterized in that the recording sheet is a multi-color recording sheet having a plurality of coloring cells dispersed within a coloring layer, the plurality of coloring cells coloring in different colors in accordance with an applied voltage, and a plurality of electrolyte cells dispersed within an electrolytic layer corresponding to the coloring species of the coloring cells, each of the electrolyte cells having an increasing electrical conductivity in a different temperature range, wherein an image is formed by heating selectively the electrolyte cells in a predetermined temperature range in accordance with the coloring species, while applying a predetermined voltage to the multi-color recording sheet in accordance with the coloring species.

With this image recording method, the coloring material for each color of yellow (Y), magenta (M) and cyan (C) is heated in a predetermined temperature range in accordance with the coloring species at an applied voltage in accordance with the coloring species, and selectively colored, whereby a multi-color image can be recorded and displayed with a single layer structure of the coloring layer.

Further, according to a fifth aspect of the invention, there is provided an image recording apparatus comprising a fixed planar electrode for laying thereon a recording sheet having a coloring layer made of an electrochromic material and an electrolytic layer with an increasing electrical conductivity in a specific temperature range, a recording head having a strip movable electrode in contact with an upper face of the recording sheet, a sliding electrode for sliding with the fixed planar electrode, and a plurality of heating elements for applying heat via the strip movable electrode to the recording sheet, the plurality of heating elements being arranged linearly, the recording head heating selectively the heating elements while applying a voltage between the strip movable electrode and the sliding electrode, and movement means for moving the recording head relative to the planar support along the direction orthogonal to a direction where the heating elements are arranged.

With this image recording apparatus, the recording head is moved by the movement means, and a thermal stimulus is given to the recording sheet by any heating elements at any movement position while at the same time a voltage is applied via the fixed planar electrode and the strip movable electrode to the recording sheet, whereby only a part where heat is applied is subjected to the coloring reaction to form an image on the recording sheet. That is, a part where voltage and heat are applied becomes display pixels. Accordingly, an image of free pattern can be recorded and displayed without forming the complex wirings like a matrix in the EC material.

Further, according to a sixth aspect of the invention, there is provided an image recording apparatus comprising a fixed planar electrode for laying thereon a recording sheet having a coloring layer made of an electrochromic material, a recording head having a plurality of independent driving electrodes arranged linearly, and a sliding electrode for sliding with the fixed planar electrode, the recording head selectively applying a voltage between the independent driving electrodes and the sliding electrode, and movement means for moving the recording head relative to the planar support along the direction orthogonal to a direction where the independent driving electrodes are arranged.

With this image recording apparatus, the recording head is moved by the movement means, and any independent driving electrodes provided on the recording head are selectively driven to bring about the coloring reaction only in a part where voltage is applied to form an image on the recording sheet. That is, a part where voltage is applied becomes display pixels. Accordingly, an image of free pattern can be recorded and displayed without forming the complex wirings like a matrix in the EC material.

Also, according to a seventh aspect of the invention, there is provided the image recording apparatus, characterized in that the fixed planar electrode is formed to be larger than the recording sheet, and the sliding electrode is disposed in the recording head to slide with an exposed portion of the fixed planar electrode extending out of the recording sheet.

With this image recording apparatus, the sliding electrode of the recording head slides with the portion of the fixed planar electrode extending out of the recording sheet, whereby the voltage can be applied to the EC material at each movement position of the recording head with a simple structure.

Also, according to an eighth aspect of the invention, there is provided the image recording apparatus, characterized in that the recording head has the sliding electrode disposed at an end portion in the direction where the heating elements or the independent driving electrodes are arranged.

With this image recording apparatus, the sliding electrode is disposed at the end portion of the recording head in the longitudinal direction, whereby the structure of the recording head can be simplified.

Also, according to a ninth aspect of the invention, there is provided the image recording apparatus, characterized in that a multi-layer recording sheet consists of a plurality of recording sheets coloring in different colors that are laminated in multiple stages and transparent electrodes interposed between the recording sheets to be exposed at the sheet end portion, and a plurality of sliding electrode are provided on the side of the recording head to slide with the transparent electrodes interposed.

With this image recording apparatus, a voltage is selectively applied from the plurality of sliding electrodes provided on the recording head to the transparent electrodes and the fixed planar electrode provided in the recording sheet, whereby an image of free pattern can be recorded and displayed on the recording sheet coloring in different colors.

Also, according to a tenth aspect of the invention, there is provided the image recording method, characterized in that the recording sheet is a multi-color recording sheet having a plurality of coloring cells dispersed within a coloring layer, the plurality of coloring cells coloring in different colors in accordance with an applied voltage, and a plurality of electrolyte cells dispersed within an electrolytic layer corresponding to the coloring species of the coloring cells, each of the electrolyte cells having an increasing electrical conductivity in a different temperature range.

With this image recording apparatus, a combination of different voltage and different heat is applied to the coloring cell provided for each color, thereby making it possible to control the coloring, whereby an image of free pattern can be recorded and displayed in multiple colors.

According to an eleventh aspect of the invention, there is provided a recording sheet characterized by having a coloring layer made of an electrochromic material, and comprising an electrolytic layer provided in contact with the coloring layer and made of an electrolyte with an increasing electrical conductivity in a specific temperature range.

With this multi-color recording sheet, the recording sheet is selectively heated in a state where voltage is applied to the recording sheet, so that only the heated part is colored. Thereby, a desired image can be recorded and displayed on the multi-color recording sheet.

Also, according to a twelfth aspect of the invention, a multi-color recording sheet characterized in that a plurality of recording sheets made of an electrochromic material and coloring in different colors are laminated in multiple stages, and the transparent electrodes are interposed between the recording sheets to be exposed at the end portion of layer.

With this multi-color recording sheet, a multi-color image can be recorded and displayed by coloring the recording sheets in different colors.

Also, according to a thirteenth aspect of the invention, there is provided the multi-color recording sheet, characterized in that a plurality of recording sheets coloring in different colors are laminated in multiple stages, and the transparent electrodes are interposed between the recording sheets to be exposed at the sheet end portion.

With this multi-color recording sheet, each recording sheet is selectively heated while voltage is applied to the recording sheet, so that color comes out only in the heated part of the recording sheet where voltage is applied. Thereby, a multi-color image can be recorded and displayed on the multi-color recording sheet.

Also, according to a fourteenth aspect of the invention, there is provided the multi-color recording sheet, characterized in that the coloring layer has a plurality of coloring cells coloring in different colors in accordance with an applied voltage dispersed therein, and the electrolytic layer has a plurality of electrolyte cells with an increasing electrical conductivity in a different temperature range dispersed corresponding to the coloring species of the coloring cells.

With this multi-color recording sheet, an electrolyte cell corresponding to a desired coloring cell is set in a temperature range where electrical conductivity increases, while voltage is applied in accordance with the desired coloring species to the recording sheets, whereby the coloring cell corresponding to this electrolyte cell colors. Thereby, the coloring cell for specific color can be selectively colored, so that a multi-color image can be recorded and displayed in a single layer structure of the coloring layer.

DESCRIPTION OF THE PREFERRED EMBODIMENTS

The preferred embodiments of an image recording method and an image recording apparatus according to the present invention will be described below in detail with reference to the accompanying drawings.

Figure 1A:
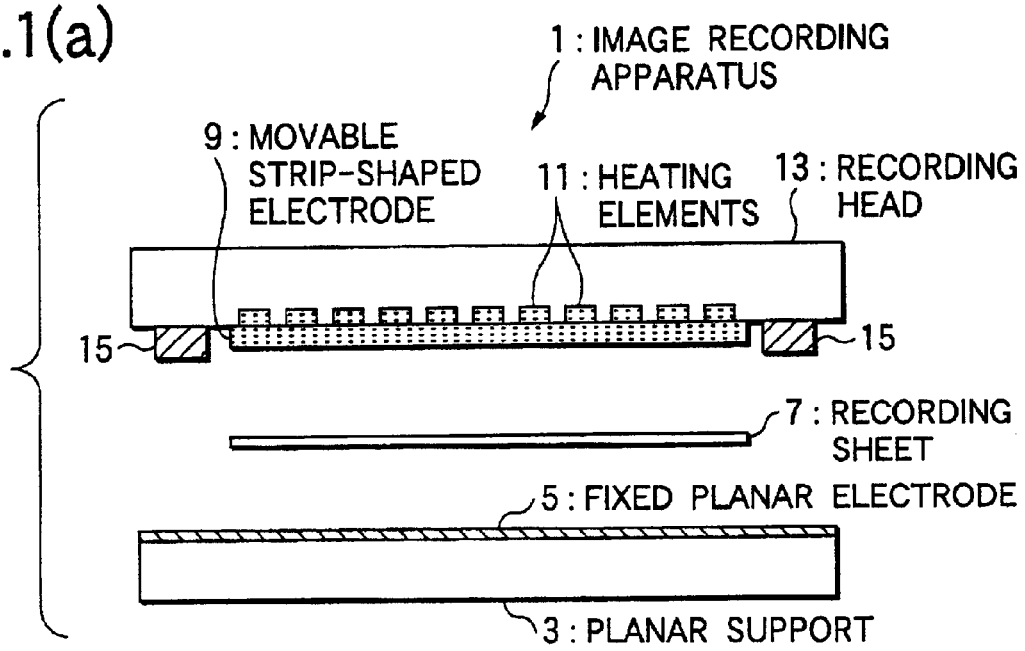
FIG. 1(*a*) and FIG. 1(*b*) are side views of an image recording apparatus according to a first embodiment of the present invention, in which FIG. 1(*a*) is an exploded view and FIG. 1(*b*) is an assembly view.
Figure 1B:
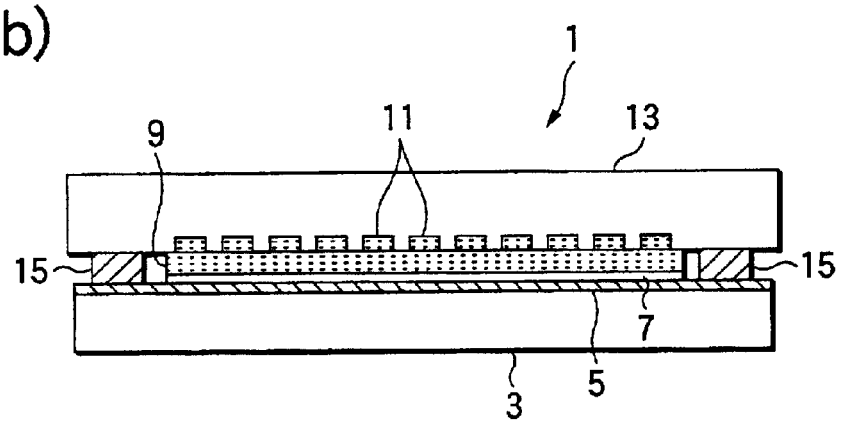
Figure 2:
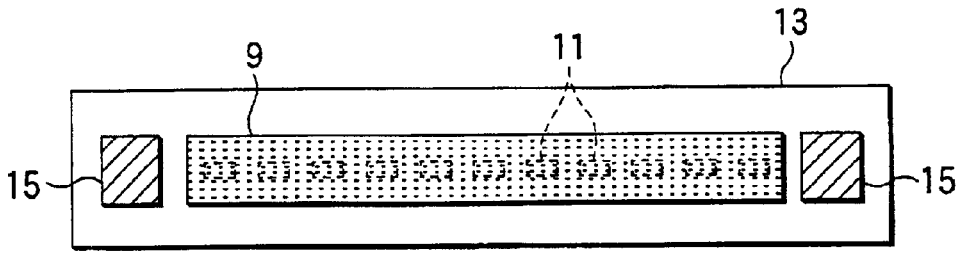
FIG. 2 is a plan view of a recording head of FIGS. 1(*a*) and 1(*b*), as seen from the underside.
Figure 3:
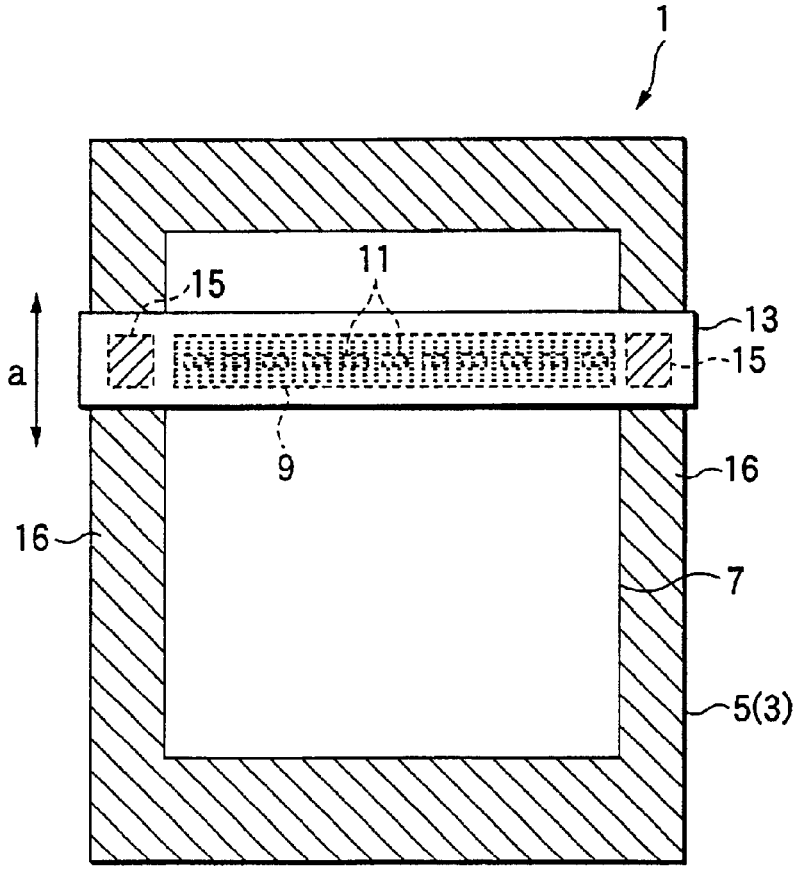
FIG. 3 is a plan view of the entire image recording apparatus.

FIGS. 1(*a*) and 1(*b*) are side views of the image recording apparatus according to a first embodiment of the invention, in which FIG. 1(*a*) is an exploded view, and FIG. 1(*b*) is an assembly view. FIG. 2 is a plan view of a recording head as shown in FIGS. 1(*a*) and 1(*b*), as seen from the lower side. FIG. 3 is a plan view of the entire image recording apparatus.

The image recording apparatus 1 of this embodiment has schematically a structure in which a recording head is installed with the recording medium carried on a base, as shown in FIG. 1(*a*) planar support 3 as the base is formed in rectangular shape, for example, and has a fixed planar electrode 5 having the same area formed on its upper face. On an upper face of the fixed planar electrode 5, there is provided a recording sheet 7 made of an EC material as will be described later in detail and having a voltage or heat applied area causing the coloring reaction. The fixed planar electrode 5 on the planar support 3 is formed to be larger than the recording sheet 7.

Above the recording sheet 7, a recording head 13 in which a plurality of heating elements 11, which have a movable strip-shaped electrode 9 making contact with the recording sheet 7 on a lower face, for applying heat via this movable strip-shaped electrode 9 to the recording sheet 7 are arranged linearly, as shown in FIG. 2. The recording head 13 is formed slender in a direction where the heating elements 11 are arranged. Also, the recording head 13 is provided to be movable in parallel to the planar support 3 in the direction orthogonal to the direction where the heating elements 11 are arranged, that is, the direction of the arrow a in FIG. 3. The heating elements 11 are simplified in the drawing, but practically arranged at high density, thereby making it possible to form an image as dense as 300 dpi or more, for example.

Also, a sliding electrode 15 is provided at either end on a lower face of the recording head 13, and slidingly makes contact with an exposed portion 16 of the fixed planar electrode 5 jutting out of the recording sheet 7. And if a voltage is applied between the movable strip-shaped electrode 9 and the sliding electrode 15 on the lower face of the recording head 13, the voltage is applied on the recording sheet 7. Also, the recording head 13 can be moved relative to the recording sheet 7 while the heating elements 11 heat selectively the recording sheet 7 in contact with the lower face of the recording head 13. Thereby, heat can be selectively applied on the entire face of the recording sheet 7 to which the voltage is applied.

The recording sheet 7 will be now described.

Figure 4:
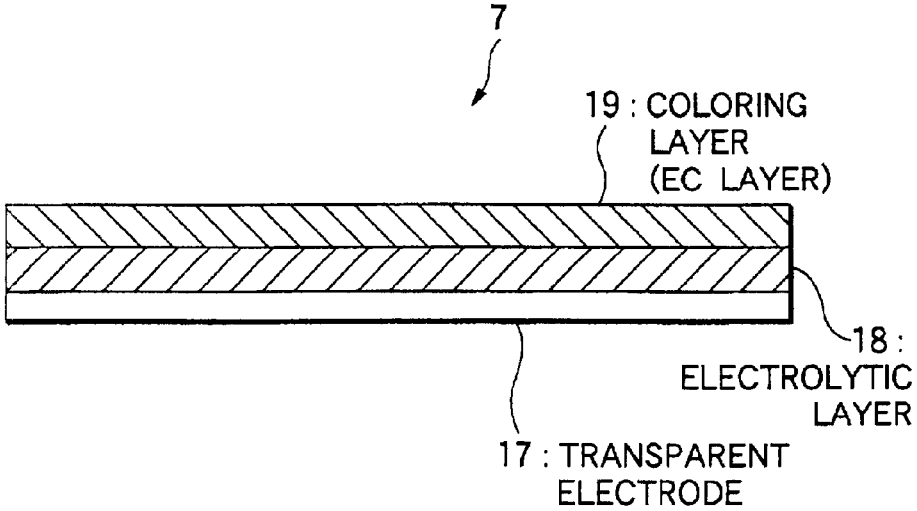
FIG. 4 is a cross-sectional view of the recording sheet for use with the image recording apparatus.

FIG. 4 is a cross-sectional view of the recording sheet 7 for use with the image recording apparatus 1 of this embodiment. The recording sheet 7 is made up by laminating successively a transparent electrode 17, an electrolytic layer 18 and a coloring layer (EC layer) 19 which serve as the support.

The transparent electrode 17 may be a transparent support such as the indium tin oxide (ITO), for example.

The electrolytic layer 18 supplies ions to the coloring layer 19 by being adjacent to the coloring layer 19, and is formed of a composite in which an ion electrolyte material is dispersed into an ion conductive resin as a matrix resin (mother layer).

The coloring layer 19 colors when an electric field is applied to it, and is formed of a composite in which a phthalocyanine based electrochromic material is dispersed into the ion conductive resin as the matrix resin (mother layer).

High molecular materials (in which electrochromic material or electrolytic material is dispersed) that serve as the matrix resin for the ion conductive resin may be applicable as long as they exhibit conductivity when an ion electrolytic material is doped, but for example, include polyvinyl alcohol (PVA) resin, polyethylene oxide (PEO) resin, polyvinyl butyral (PVB) resin, polyvinyl carbazole resin, vinyl acetate resin, xylene resin and polycarbonate resin.

The ion electrolytic materials dispersed into the matrix resin (ion conductive resin) of the electrolytic layer 18 may be organic materials such as basic dry high molecular solid electrolytic materials. To produce high molecular solid electrolyte, substitutional vinyl monomer having a polyether structure, a polysulfide structure, or a polyethylene imino structure is employed. Substitutional vinyl groups may include ethylene group, styrene group, butadiene group, vinyl chloride group, vinyl acetate group, acrylic acid group, methyl acrylate group, methyl vinyl ketone group, acrylic amido group, methacrylic acid group, and methyl methacrylate group. For example, those compounds listed in the table 1 below may be used. Also, those compounds may be mixed with monomers of other structure to make copolymer and adjust the material properties.

TABLE 1

| Basic structure | Substituent group |
|---|---|
| $R_1$-$(OCH_2CH_2)_nO$—$R_2$ | $R_1$ |
| $R_1$-$(SCH_2CH_2)_nS$—$R_2$ | $CH_2$=CH— Ethylene group |
| $R_1$-$(NHCH_2CH_2)_nNH$—$R_2$ | $CH_2$=$CC_6H_5$— Styrene group |
| | $CH_2$=$CHCH_2$— Propylene group |
| | $CH_2$=$CHCH_2CH_2$— Butene group |
| | $CH_2$=CHCH=CH— Butadiene group |
| | $CH_2$=CCl— Vinyl chloride group |
| | $CH_2$=$CH_3COOC$— Vinyl acetate group |
| | $CH_2$=CHCO— Acrylic acid group |
| | $CH_2$=$CH_3COOCH_2$— Methyl acrylate group |
| | $CH_2$=$C(CH_3)CO$— Methacrylic acid group |
| | $CH_2$=$C(CH_3)COOCH_2$— Methyl methacrylate group |
| | $CH_2$=$CHCOCH_2$— Methyl vinyl keton group |
| | $CH_2$=CHCONH— Acrylic amide group |
| | $R_2$ |
| | $H_3$ |
| | $CH_3$ |
| | $R_1$ |

A wide variety of supporting electrolytes can be employed as long as they are dissolved in high molecular solid electrolyte. For example, usable compounds are listed in table 2 as below.

TABLE 2

| Classification | Specific example |
|---|---|
| Inorganic acid anion-Alkaline metal salt | $XAsF_6$, $XPF_6$, $XBF_4$, $XC1O_4$ (X = H, Li, K, Na) |
| Organic acid anion-Alkaline metal salt | $XCF_3SO_3$, $XC_nF_{2n+1}SO_3$ (n = 2, 4, 8) XN $(CF_3SO_2)_2$, $XC(CF_3SO_2)_3$, XB $(CH_3)_4$, XB $(C_6H_5)_4$ (X = H, Li, K, Na) |
| Quaternary ammonium salt | $[CH_3(CH_2)_3]_4N.Y$ $C_nH_{2n+1}N(CH_3)_3.Y$ (n = 10~18) $(C_nH_{2n+1})_2N(CH_3)_2.Y$ (n = 10~18) (Y = $BF_4$, $PF_6$, $ClO_4$, F, Cl, Br, OH) |
| Anionic surface active agent | $C_nH_{2n+1}COO.X$ (n = 10~18) $C_nH_{2n+1}OC_mH_{2m}COO.X$ (n = 10~18, m = 10~18) $C_{10}H_7COO.X$ $C_nH_{2n+1}C_{10}H_6COO.X$ (n = 10~18) $C_nH_{2n+1}OC_mH_{2m}SO_3.X$ (n = 10~18, m = 10~18) $C_{10}H_7SO_3.X$ $C_nH_{2n+1}C_{10}H_6SO_3.X$ (n = 10~18) $C_nH_{2n+1}OSO_3.X$ (n = 10~18) (X = H, Li, K, Na) |

TABLE 2-continued

| Classification | Specific example |
|---|---|
| Imidazolium salt | 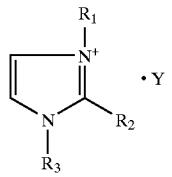 ($R_1$ = —H, —$CH_3$, $C_2H_5$, $C_3H_7$, $R_2$ = —H, —$CH_3$, $C_2H_5$, $C_3H_7$, $R_3$ = —H, —$CH_3$, $C_2H_5$, $C_3H_7$, Y = $BF_4$, $PF_6$, $ClO_4$, F, Cl, Br, OH) |

The electrolyte made of an organic material typically has a property that the ion conductivity is varied with heat. This electrolyte shows only an ion conductivity of about $10^{-8}$ to $10^{-6}$S/cm at room temperatures, but has an increased ion conductivity of about $10^{-5}$ to $10^{-3}$S/cm by heating. That is, the electrolyte has no change by applying a voltage to the electrodes at room temperatures, but has colors coming out by applying the same voltage at high temperatures.

However, this ion conductivity increases continuously with the temperature, and when the electrolytic layer 18 is amorphous, it exhibits no critical point in characteristic change such as critical temperature, whereby it is difficult to control coloring. Hence, the electrolyte used for the electrolytic layer 18 is preferably electrolyte of crystalline system. The crystalline electrolyte is most simply normal linear polyethylene oxide (PEO) The electrochromic materials dispersed into a matrix resin (ion conductive resin) of the coloring layer 19 may include rare earth metallodiphthalocyanine, Sn phthalocyanine, Co phthalocyanine, and Mo phthalocyanine which are capable of polychromatic representation.

Rare earth metallodiphthalocyanine for use as the electrochromic material is capable of polychromatic representation, and among others, lanthanoid metal is preferable because it is capable of polychromatism in red, blue and green. Examples of lanthanoid metal include lutetium (Lu), ytterbium (Yb), thulium (Tm), erbium (Er), holomium (Ho), dysprosium (Dy), terbium (Tb), gadolinium (Gd), europium (Eu), samarium (Sm), promethium (Pm), neodymium (Nd), praseodymium (Pr), cesium (Ce), and lanthanum (La).

A film formation method for the electrolytic layer 18 and the coloring layer 19 is a spin coating or dip coating method, etc. The recording sheet 7 as shown in FIG. 4 has the coloring layer 19 formed on the electrolytic layer 18, but conversely may have the electrolytic layer 18 adjacent the coloring layer 19.

With the structure of the recording sheet 7, the coloring layer 19 can be colored by heating while applying a voltage between the fixed planar electrode 5 and the movable strip-shaped electrode 9.

An image recording method using an image recording apparatus 1 thus constituted will be described below.

In order for the image recording apparatus to record an image on the recording sheet 1, a voltage is applied between the fixed planar electrode 5 and the movable strip-shaped electrode 9, and a desired heating element 11 is heated on the basis of the image data, in which the head 13 is moved in parallel while giving a thermal stimulus on the recording sheet 7. When the desired display pixel of the recording sheet 7 is heated by the heating element 11, a color comes out in accordance with an applied voltage at the heated position of the recording sheet 7. Thereby, only a part of the recording sheet 13 to which heat is applied by any heating elements 11 is subjected to coloring reaction, so that an image is formed on the recording sheet 7. That is, a part to which heat and voltage are applied becomes a display pixel. Accordingly, an image of free pattern can be recorded on the recording sheet 7 without forming complex wirings like a matrix on the EC material.

Also, the image recording apparatus 1 can be employed as a reversible recording/display apparatus, when a hue change of the coloring material used for the recording sheet 7, or coloring or decoloring is reversible. Taking an example of coloring or decoloring, the recording sheet 7 is heated on the entire surface and a voltage is applied in a direction where the EC compound decolors (e.g., a reduction voltage when an oxidation voltage is applied for coloring) in order to erase an image after being formed of an EC compound, as described previously. With this application of voltage, the coloring material that has colored loses color, and other coloring material has no change, whereby the formed image can be erased. The formation and erasure of image this way can be made many times repeatedly only by applying a thermal stimulus and controlling the voltage until the life of EC compound runs out.

In addition to the above configuration in which a single coloring layer has a specific color coming out, the single coloring layer may have a plurality of colors coming out. One example of this recording sheet will be given below.

Figure 5:
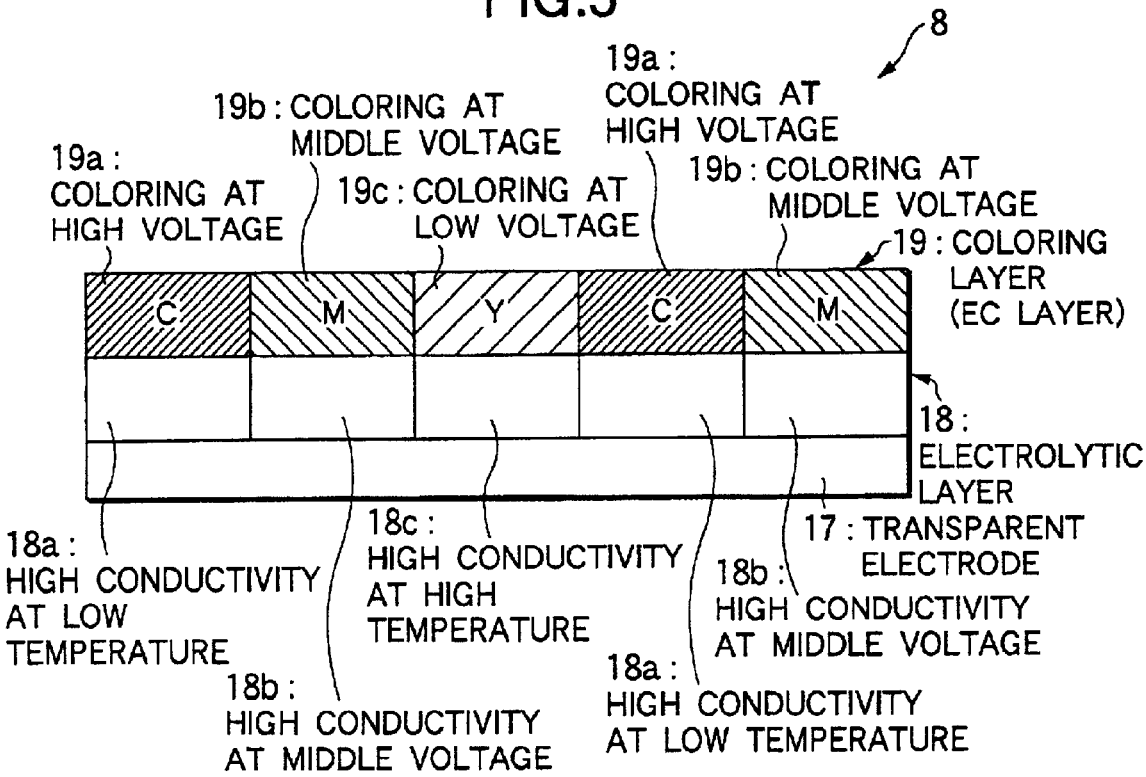
FIG. 5 is a partial cross-sectional view of the recording sheet in which multiple colors can come out in a single coloring layer.

In this case, the recording sheet 8 has a coloring layer 19 formed for each color and an electrolytic layer 18 corresponding to the coloring layer 19, as shown in a partial cross-sectional view of FIG. 5, for example.

Each electrolytic layer 18 has a characteristic in which the electrical conductivity is greatly varied at different temperatures, and can selectively control the coloring owing to this temperature characteristic. A specific melting point causing the critical point of characteristic change is varied depending on the molecular weight of PEO, the kind of supporting electrolyte, and the ratio of PEO to supporting electrolyte, whereby when a material having three kinds of temperature change points is mixed, for example, three kinds of electrolytes may be employed, making use of the above property.

The recording sheet 8 as shown in FIG. 5 is formed with the coloring layer 19 in which the coloring cells 19*a*, 19*b*, 19*c* coloring in three colors of cyan (C), magenta (M) and yellow (Y) are dispersed, and the electrolytic layer 18 in which electrolytic cells 18*a*, 18*b*, 18*c* made of an electrolyte of different kind for each color are dispersed corresponding to the coloring species of the coloring cells 19*a*, 19*b* and 19*c*.

Specifically, an electrolytic cell 18*a* having the electrical conductivity increasing above a low temperature (e.g., 70° C.) is placed adjacent a coloring cell 19*a* for C color, an electrolytic cell 18*b* having the electrical conductivity increasing above a middle temperature (e.g., 85° C.) is placed adjacent a coloring cell 19*b* for M color, and an electrolytic cell 18*c* having the electrical conductivity increasing above a high temperature (e.g., 100° C.) is placed adjacent a coloring cell 19*c* for Y color. Each electrochromic layer is chosen to have a different coloring voltage, in which the electrochromic layer for C color is colored at a high voltage (e.g., 100V) or more, the electrochromic layer for M color at a middle voltage (e.g., 70V) or more, and the electrochromic layer for Y color at a low voltage (e.g., 30V) or more. Table 3 lists the relation between heating temperature, interelectrode voltage and coloring with this constitution. The size of cell for one color is made 100 $\mu$m or less, and the cells may be arranged regularly or at random.

TABLE 3

| | | Temperature | | |
|---|---|---|---|---|
| Voltage | High voltage 100 V | C | | |
| | Middle voltage 70 V | | M | |
| | Low voltage 30 V | | | Y |
| | | Low temperature 70 | Middle temperature 85 | High temperature 100 |

An image recording method with this recording sheet 8 involves moving the recording head 13 to give a thermal stimulus to the surface of the recording sheet 8, while heating the heating element 11 at high temperature in accordance with the image data of Y color, for example, in a state where the interelectrode voltage between the fixed planar electrode 5 and the movable strip-shaped electrode 9 for the recording head 13 is set at a predetermined low voltage. Then, the recording head 13 is restored to an initial position, or the movement direction is reversed, and the recording head 13 is similarly moved, while heating the heating element 11 at middle temperature in accordance with the image data of M color in a state where the interelectrode voltage is set at a predetermined middle voltage. And the recording head 13 is similarly moved, while heating the heating element 11 at low temperature in accordance with the image data of C color in a state where the interelectrode voltage is set at a predetermined high voltage. Through these three times of scanning, the image data of Y, M and C colors are recorded on the recording sheet, and an image corresponding to this image data is displayed. The deletion can be achieved by making the entire face at high temperature and high reverse voltage.

With the above constitution of the recording sheet 8, even the single recording sheet can represent a plurality of colors, and a full color image can be formed in colors of Y, M and C. Thereby, an image of free pattern can be recorded or displayed without forming a complex wiring like a matrix in the EC material.

A second embodiment of the image recording apparatus according to the invention will be described below.

Figure 6A:
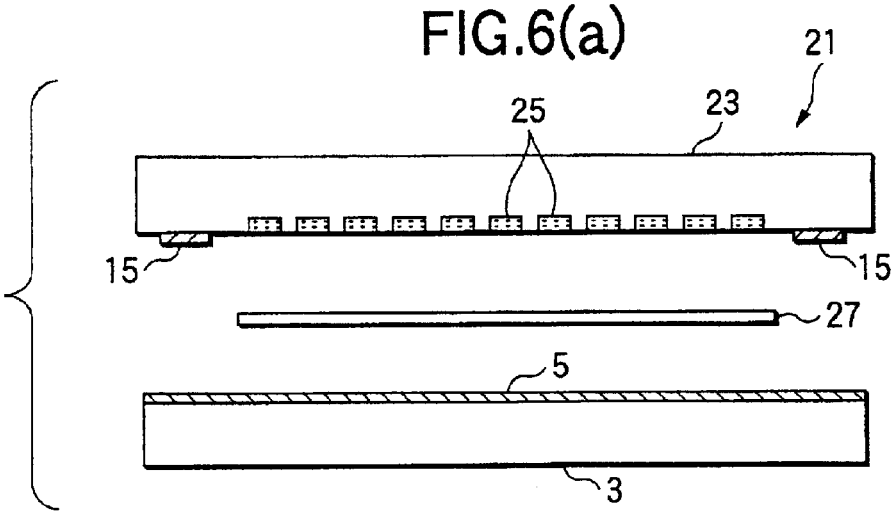
FIG. 6(*a*) and FIG. 6(*b*) are side views of the image recording apparatus according to a second embodiment of the invention, in which FIG. 6(*a*) is an exploded view and FIG. 6(*b*) is an assembly view.
Figure 6B:
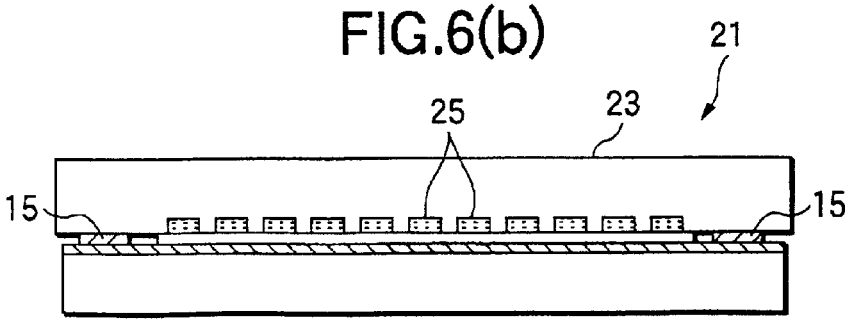

FIGS. 6(*a*) and 6(*b*) are side views of the image recording apparatus according to the second embodiment of the invention, in which FIG. 6(*a*) is an exploded view and FIG. 6(*b*) is an assembly view. In the following embodiment, the same or like parts are designated by the same numerals as shown in FIGS. 1(*a*) and 1(*b*), and duplicate explanation is omitted.

The image recording apparatus 21 of this embodiment is provided a plurality of independent driving electrodes 25, instead of the heating element 11 as above, in a recording head 23, in which the movable strip-shaped electrode is omitted. Other constitution is the same as the image recording apparatus 1 as described above.

In the recording sheet 27 as used herein, the electrolytic layer 18 always has electrical conductivity without requiring thermal stimulus. The electrolytic layer 18 is formed of a composite in which an ion electrolytic material is dispersed into an ion conductive resin as a matrix resin (mother layer). Specific examples of ion electrolytic material dispersed into the matrix resin (ion conductive resin) include alkaline metal salts, such as NaCl, $LiClO_4$, KCl and $H_2O$, and others, such as LiCl, LiBr, LiI, $LiNO_3$, LiSCN, $LiCF_3SO_3$, NaBr, NaI, NaSCN, $NaClO_4$, $NaCF_3SO_3$, KI, KSCN, $KClO_4$, $KCF_3SO_3$, $NH_4I$, $NH_4SCN$, $NH_4ClO_4$, $NH_4CF_3SO_3$, $MgCl_2$, $MgBr_2$, $MgI_2$, $Mg(NO_3)_2$, $Mg(SCN)_2$, $Mg(CF_3SO_3)_2$, $Ca(Br)_2$, $CaI_2$, $Ca(SCN)_2$, $Ca(ClO_4)_2$, $Ca(CF_3SO_3)_2$, $Zn(Cl)_2$, $ZnI_2$, $Zn(SCN)_2$, $Zn(ClO_4)_2$, $Zn(CF_3SO_3)_2$, $Cu(Cl)_2$, $CuI_2$, $Cu(SCN)_2$, $Cu(ClO_4)_2$, and $Cu(CF_3SO_3)_2$.

The electrolytes of organic material as shown in the first embodiment are usable as far as they have electrical conductivity at ordinary temperature.

With this image recording apparatus 21, the recording head 23 having a plurality of independent driving electrodes 25 arranged is moved relative to the surface of the recording sheet 27, and if a voltage is applied by arbitrary independent driving electrode 25, a part with the voltage applied is only subjected to coloring reaction, so that an image is formed on the recording sheet 27. That is, only a part with the voltage applied makes up display pixels to allow an image of free pattern to be recorded or displayed, without forming the complex matrix-like wirings in the EC material, similarly with the image recording apparatus 1.

Figure 7:
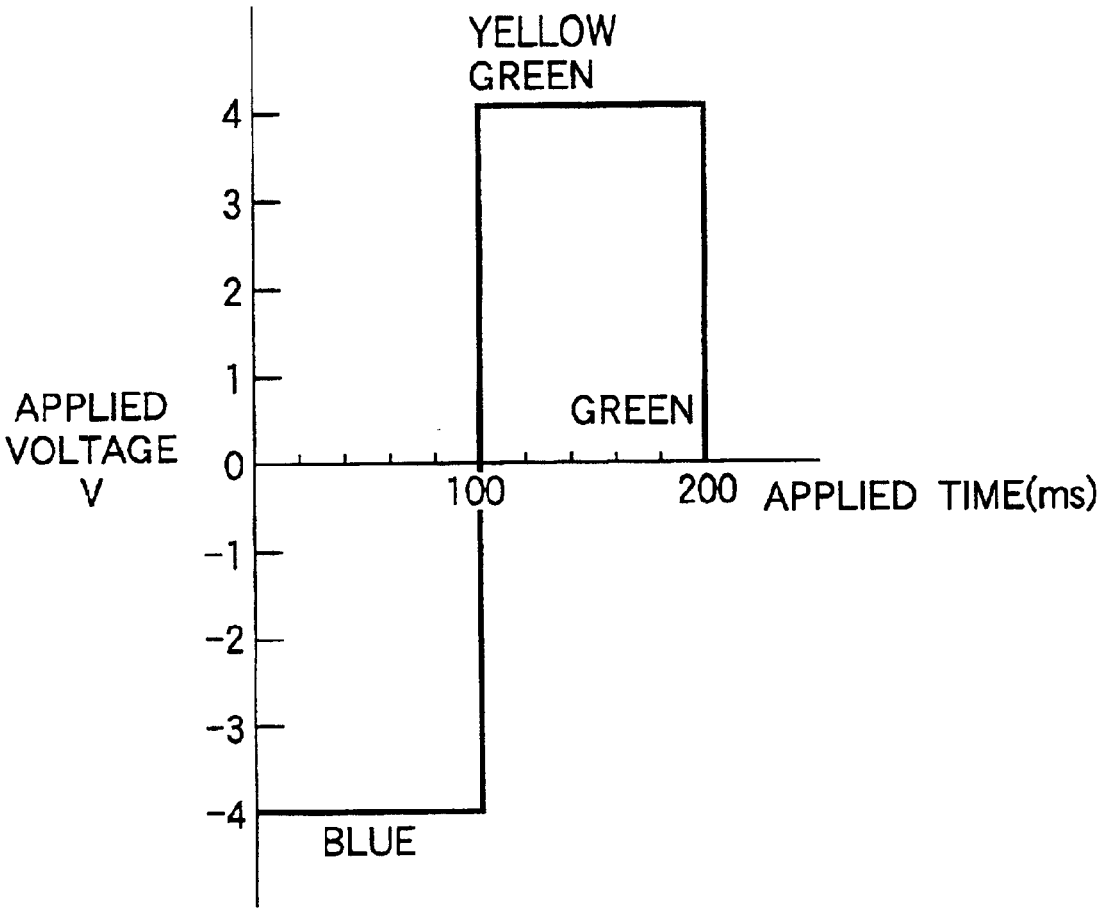
FIG. 7 is a graph showing one example of applied voltage waveform in which a pulse of voltage as long as 100 ms is applied between the fixed planar electrode and the movable strip-shaped electrode to cause colors to come out in the coloring layer.

FIG. 7 shows one example of applied voltage waveform in which the coloring layer is colored by applying a pulse of voltage as long as 100 ms between the fixed planar electrode 5 and the movable strip-shaped electrode 9. This recording sheet 27 is colored in blue, yellow green and green by varying the applied voltage so that the interelectrode voltage may get at −4V, 0V and 4V, respectively. This applied voltage is set to any value by the image recording apparatus 1.

In this way, with the structure of the recording sheet 7 as above, the oxidation and reduction condition of rare earth metallodiphthalocyanine (electrochromic grains) is chosen arbitrarily in accordance with a voltage value applied between the fixed planar electrode 5 and the independent driving electrode 25, so that the coloring layer 19 can be colored in plural colors corresponding to positive and negative voltage values.

With this image recording apparatus 21, an image of free pattern can be recorded and displayed without applying thermal shock, the recording sheet does not degenerate due to heat and the image recording apparatus can be simplified in structure.

A third embodiment of the image recording apparatus according to the invention will be described below.

Figure 8A:
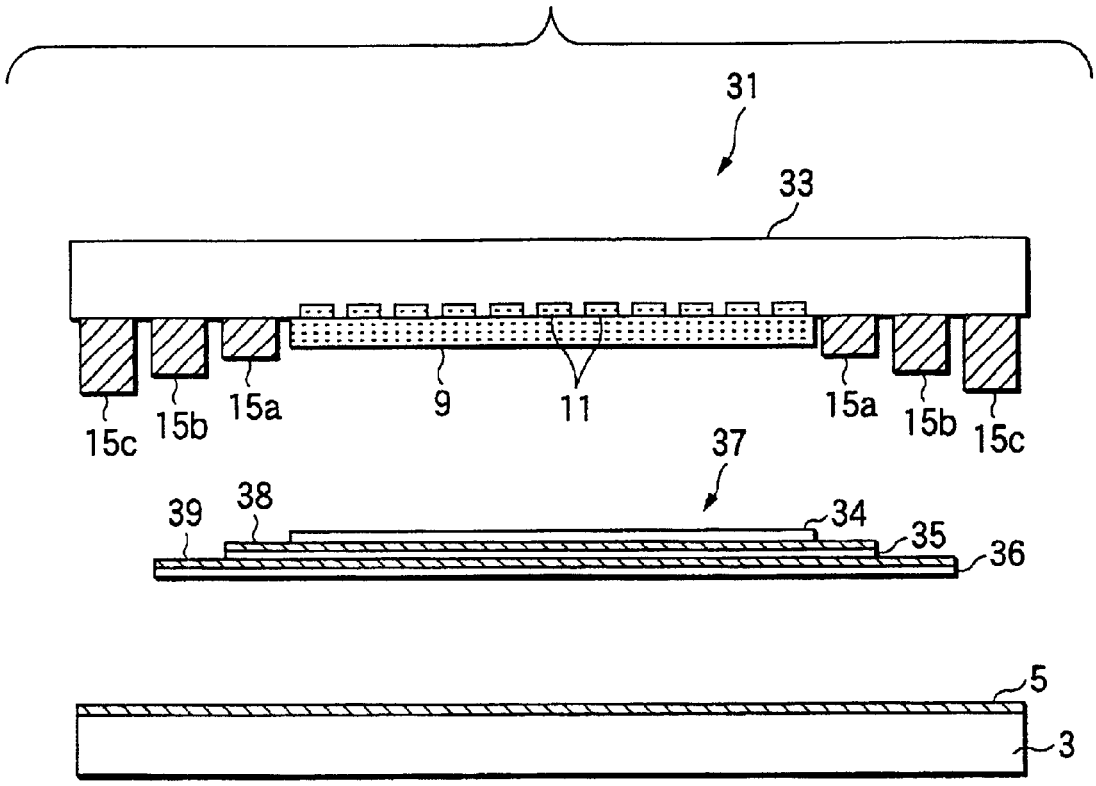
FIGS. 8(*a*) and 8(*b*) are side views of the image recording apparatus according to a third embodiment of the invention, in which FIG. 8(*a*) is an exploded view and FIG. 8(*b*) is an assembly view.
Figure 8B:
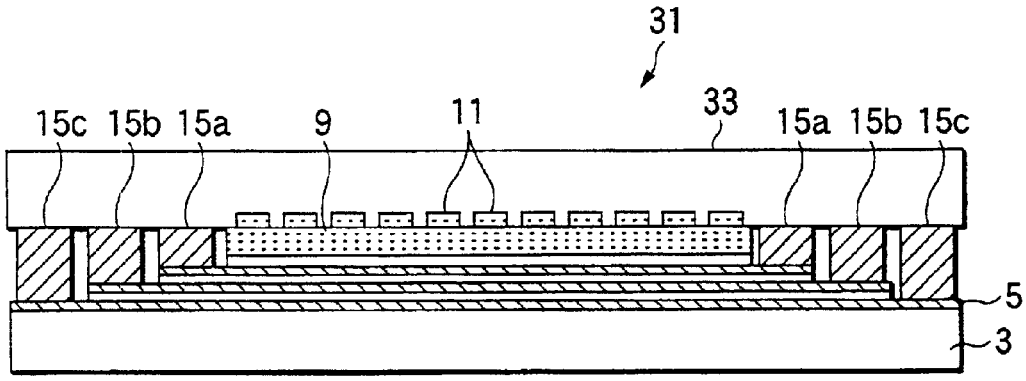
Figure 9A:
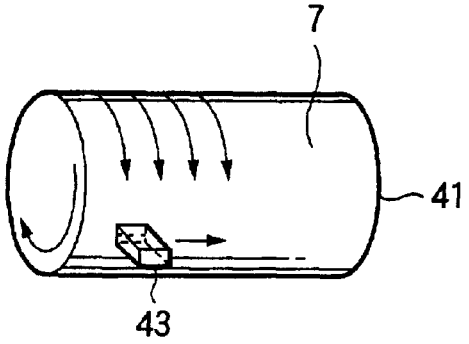
FIGS. 9(*a*) through 9(*e*) are explanatory views showing variations (a) to (e) in which the EC material and the recording head are relatively moved.
Figure 9B:
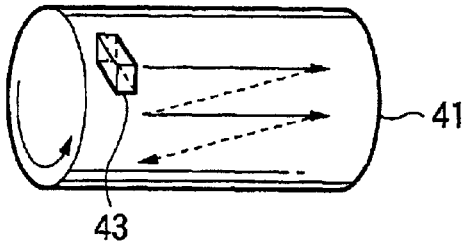
Figure 9C:
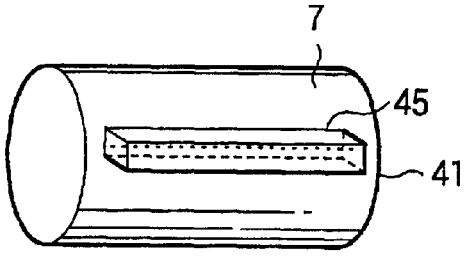
Figure 9D:
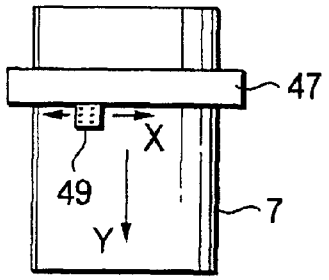
Figure 9E:
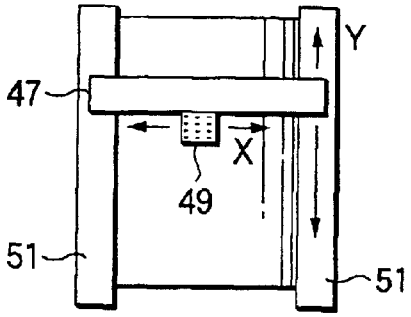

FIGS. 8(*a*) and 8(*b*) are side views of the image recording apparatus according to the third embodiment of the invention, in which FIG. 8(*a*) is an exploded view and FIG. 8(*b*) is an assembly view.

The image recording apparatus 31 of this embodiment employs a multi-layer recording sheet 37 in which a plurality of recording sheets 34, 35 and 36 coloring in different colors (three colors in this embodiment) are laminated and the transparent planar electrodes 38 and 39 such as ITO are interposed on the lower surface of the recording sheets 34 and 35. The recording sheets 34, 35 and 36 of the multi-layer recording sheet 37 are made of the EC materials coloring in yellow (Y), magenta (M) and cyan (C), respectively.

This multi-layer recording sheet 37 is laid on the fixed planar electrode 5 formed on the upper face of the planar support 3, and the recording head 13 having the movable strip-shaped electrode 9 on the lower face and arranged with a plurality of heating elements 11 for applying heat via the movable strip-shaped electrode 9 is provided above the multi-layer recording sheet 37. The recording sheets 34, 35 and 36 are formed such that the upper layers have smaller area, with the end portion being stepped. Thereby, the planar electrode 38 extends over the upper surface of the recording sheet 35 on the lower layer, and similarly, the planar electrode 39 extends over the upper surface of the recording sheet 36 on the lower layer. On one hand, three sliding electrodes 15*a*, 15*b* and 15*c* are provided on the lower surface of the recording head 33 at both ends in the longitudinal direction, so as to have a shorter pendent length inward of the recording head 33. The sliding electrodes 15*a*, 15*b* and 15*c* makes contact with the planar electrodes 38, 39 and the fixed planar electrode 5 at the end of the multi-layer recording sheet 37 exposed, respectively.

With this image recording apparatus 31, when the recording for Y color is made, for example, a voltage is applied only to the recording sheet for Y color (e.g., recording sheet 34), the heating element 11 is heated in accordance with the image data corresponding to that color, thereby giving a thermal stimulus to the recording sheet 34. In this way, by similarly giving a thermal stimulus to each of the recording sheet 35 for C color and the recording sheet 36 for M color in accordance with the image data, an image of free pattern can be recorded or displayed in multi-color.

In this embodiment, the same recording sheet as in the first embodiment is employed, but the recording may be made by applying an electric field without heating as in the second embodiment. In this case, the image recording apparatus 31 may be configured such that a voltage is applied between the independent driving electrode and the fixed planar electrode in the same manner as in the second embodiment.

In the first, second and third embodiments as described above, the planar recording sheet is fixed and the recording head is moved relative to this recording sheet. However, the image recording apparatus according to this invention may take another form, so long as the recording sheet and the recording head are moved relatively.

As other constitutions for allowing relative movement, a constitution in which the recording sheet 7 is fixed on the circumferential face of the planar support that is formed of a drum 41, the recording head 43 is moved in the axial direction of the drum 41 to make the recording in spiral locus on the circumferential face of the drum 41, as shown in FIG. 9(*a*), a constitution in which the recording sheet 7 is fixed on the circumferential face of the drum 41, and the recording head 43 is moved in the axial direction of the drum 41 to make the recording in parallel to the axis, as shown in FIG. 9(*b*), a constitution in which the recording sheet 7 is fixed on the circumferential face of the drum 41, and the line recording head 45 with a plurality of heating elements 11 arranged in linear direction is moved in the axial direction of the drum 41 to make the recording, as shown in FIG. 9(*c*), a constitution in which the recording head 49 movable in the X direction is provided on the bridge 47, and the recording sheet 7 is conveyed in the Y direction to make the recording, as shown in FIG. 9(*d*), and a constitution in which the recording head 49 movable in the X direction is provided on the bridge 47, and the bridge 47 is moved in the Y direction along the support rail 51 to make the recording, as shown in FIG. 9(*e*), for example.

As described above, with the image recording method according to this invention, heat is applied to any position of the recording sheet by heating elements, while at the same time a voltage is applied on the front and back faces of the recording sheet to subject only arbitrary part of the recording sheet to coloring reaction to form an image on the recording sheet, whereby a part with voltage and heat applied can be made display pixels, and an image of free pattern can be recorded or displayed without forming the complex wirings like a matrix in the EC material. As a result, the image recording apparatus using the EC material can be produced at lower manufacturing costs.

The image recording apparatus according to this invention, the recording sheet is provided on the upper face of the fixed planar electrode, and the recording head is moved relative to the recording sheet, in which heat is applied by a plurality of heating elements while the movable strip-shaped electrode contacts with the surface of the recording sheet, whereby heat and voltage can be applied to the desired position to subject the arbitrary part to coloring reaction. As a result, arbitrary position of the EC material can be subjected to coloring reaction to make display pixels, without forming the complex wirings in the EC material, whereby an image of free pattern can be recorded or displayed.

A voltage is selectively applied from a sliding electrode provided for each color to the recording sheet for each color, a combination of different voltage and different heat is applied to the coloring material provided for each color to control the coloring, whereby an image of free pattern can be recorded or displayed.

The recording sheet according to this invention has a coloring layer made of an electrochromic material, and an electrolytic layer made of electrolyte provided in contact with the coloring layer and with the electrical conductivity increasing in a specific temperature range, whereby the image recording apparatus can record and display a desired image having colors coming out by heating a selective part in a state where a voltage is applied. Also, a plurality of recording sheets made of electrochromic material and coloring indifferent colors are laminated at multiple stages, and a transparent electrode is interposed between recording sheets to be exposed at the ends of the recording sheet, whereby each recording sheet can be colored in different colors to record and display a multi-color image. Further, a plurality of coloring cells coloring in different colors are dispersed to form the coloring layer, the electrolyte cells having the electrical conductivity increasing in different temperature ranges are dispersed corresponding to the coloring species of the coloring cells to form the electrolytic layer, whereby a multi-color image can be recorded and displayed while the coloring layer is in the single layer structure.

What is claimed is:

1. An image recording method employing a recording sheet having a coloring layer made of an electrochromic material and an electrolytic layer with an increased electrical conductivity in a specific temperature range, characterized by including moving a recording head with a plurality of heating elements arranged in a linear direction relative to the surface of said recording sheet in the direction orthogonal to said linear direction while at the same time applying a voltage to the front and back faces of said recording sheet, and causing a coloring reaction only in a part where heat is applied by said heating elements to form an image on said recording sheet.

2. An image recording method employing a recording sheet having a coloring layer made of an electrochromic material, characterized by including moving a recording head with a plurality of independently driven electrodes arranged in a linear direction relative to the surface of said recording sheet in the direction orthogonal to said linear direction, and causing a coloring reaction only in a part where voltage is applied by said independently driven electrodes to form an image on said recording sheet.

3. The image recording method according to claim 1 or 2, characterized in that said recording sheet is a laminated recording sheet in which a plurality of recording sheets coloring in different colors are laminated in multiple stages, in which an image is formed by applying selectively a voltage to a recording sheet of each color.

4. The image recording method according to claim 1, characterized in that said recording sheet is a multi-color recording sheet having a plurality of coloring cells dispersed within a coloring layer, said plurality of coloring cells coloring in different colors in accordance with an applied voltage, and a plurality of electrolyte cells dispersed within an electrolytic layer corresponding to the coloring species of said coloring cells, the electrolyte cells of each of the coloring species having an increased electrical conductivity in a different temperature range, wherein an image is formed by heating selectively said electrolyte cells in a predetermined temperature range in accordance with the coloring species, while applying a predetermined voltage to said multi-color recording sheet in accordance with the coloring species.

5. An image recording apparatus comprising:

a fixed planar electrode for laying thereon a recording sheet having a coloring layer made of an electrochromic material and an electrolytic layer with an increased electrical conductivity in a specific temperature range;

a recording head having a movable strip-shaped electrode in contact with an upper face of said recording sheet, a sliding electrode for sliding with said fixed planar electrode, and a plurality of heating elements for applying heat via said movable strip-shaped electrode to said recording sheet, said plurality of heating elements being arranged linearly, said recording head heating selectively said heating elements while applying a voltage between said strip movable electrode and said sliding electrode; and movement means for moving said recording head relative to said planar support along the direction orthogonal to a direction where said heating elements are arranged.

6. An image recording apparatus comprising:

a fixed planar electrode for laying thereon a recording sheet having a coloring layer made of an electrochromic material;

a recording head having a plurality of independent driving electrodes arranged linearly, and a sliding electrode for sliding with said fixed planar electrode, said recording head selectively applying a voltage between said independent driving electrodes and said sliding electrode; and movement means for moving said recording head relative to said planar support along the direction orthogonal to a direction where said independent driving electrodes are arranged.

7. The image recording apparatus according to claim 5 or 6, characterized in that said fixed planar electrode is formed to be larger than said recording sheet, and said sliding electrode is disposed in said recording head to slide with an exposed portion of said fixed planar electrode extending out of said recording sheet.

8. The image recording apparatus according to claim 7, characterized in that said recording head has said sliding electrode disposed at an end portion in the direction where said heating elements or said independent driving electrodes are arranged.

9. The image recording apparatus according to claim 5 or claim 6, characterized in that a multi-layer recording sheet consists of a plurality of recording sheets coloring in different colors that are laminated in multiple stages and transparent electrodes interposed between the recording sheets to be exposed at the sheet end portion, and a plurality of sliding electrode are provided on the side of the recording head to slide with said transparent electrodes interposed.

10. The image recording apparatus according to claim 5 or claim 6, characterized in that said recording sheet is a multi-color recording sheet having a plurality of coloring cells dispersed within a coloring layer, said plurality of coloring cells coloring in different colors in accordance with an applied voltage, and a plurality of electrolyte cells dispersed within an electrolytic layer corresponding to the coloring species of said coloring cells, the electrolyte cells of each coloring species having an increasing electrical conductivity in a different temperature range.

* * * * *